US008400247B2

(12) United States Patent
Ono

(10) Patent No.: US 8,400,247 B2
(45) Date of Patent: Mar. 19, 2013

(54) COIL COMPONENT, REACTOR, AND METHOD FOR FORMING COIL COMPONENT

(75) Inventor: Hiroshi Ono, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 29 days.

(21) Appl. No.: 13/103,678

(22) Filed: May 9, 2011

(65) Prior Publication Data

US 2011/0279210 A1 Nov. 17, 2011

(30) Foreign Application Priority Data

May 14, 2010 (JP) ..... 2010-112643

(51) Int. Cl.
*H01F 27/29* (2006.01)

(52) U.S. Cl. ..... 336/192

(58) Field of Classification Search ..... 336/65, 336/192, 180–184, 220–223
See application file for complete search history.

(56) References Cited

U.S. PATENT DOCUMENTS

| | | | | |
|---|---|---|---|---|
| 6,927,660 | B2 * | 8/2005 | Okamoto | 336/192 |
| 2004/0041676 | A1 * | 3/2004 | Okamoto | 336/90 |
| 2009/0144967 | A1 * | 6/2009 | Hasu et al. | 29/605 |
| 2010/0141373 | A1 * | 6/2010 | Murakami | 336/223 |
| 2010/0321145 | A1 * | 12/2010 | Kaoru et al. | 336/222 |
| 2011/0156853 | A1 * | 6/2011 | Kato et al. | 336/192 |

FOREIGN PATENT DOCUMENTS

| | | | |
|---|---|---|---|
| JP | 3737461 | B2 | 2/2004 |
| JP | 2007-305803 | A | 11/2007 |

* cited by examiner

*Primary Examiner* — Tuyen Nguyen
(74) *Attorney, Agent, or Firm* — Sughrue Mion, PLLC

(57) ABSTRACT

A coil component comprises a plurality of coil elements arranged side-by-side and a connecting portion that interconnects the coil elements. The plurality of coil elements are formed from a single flat wire wound edgewise so that the coil elements wind in the same direction. The connecting portion includes a portion of the flat wire between the two coil elements wound edgewise, wherein a part of the connection portion protrudes radially outward from the two coil elements. The connecting portion is bent flatwise at two positions so that the two coil elements are arranged side-by-side with their axes in parallel with each other.

8 Claims, 5 Drawing Sheets

COIL COMPONENT, REACTOR, AND METHOD FOR FORMING COIL COMPONENT

TECHNICAL FIELD

The present invention relates to a coil component, a reactor, and a method for forming a coil component.

BACKGROUND

As a coil component, a technique for forming two coil elements using a single flat wire is disclosed in Japanese Patent No. 3737461 and Japanese Laid-open Patent Publication No. 2007-305803. Specifically, in Japanese Patent No. 3737461, two coil elements having offset axes are formed by winding a single flat wire edgewise. In Japanese Laid-open Patent Publication No. 2007-305803, the winding directions are opposite for right and left coil elements, i.e., after a single flat wire is wound to form a first coil element in one direction, the necessary length of flat wire for forming a second coil element is sent forth and wound back in the opposite direction to form a second coil element.

SUMMARY OF THE INVENTION

As in Japanese Patent No. 3737461, in the case where two coil elements are formed by offsetting their axes while a single flat wire is wound edgewise, increasing the speed is difficult since offsetting of the axes is required and swing of the flat wire while coiling becomes great.

As in Laid-open Patent Publication No. 2007-305803, after a single flat wire is wound to form a first coil element, a necessary length of the flat wire for forming a second coil element is sent forth. Coiling of the second elements is conducted after the necessary length of the flat wire is all pulled out. This adds time when distance between the two coil elements is great. In addition, a first coil element swings during the time when the second coil element is coiled. This makes increasing the coiling speed difficult. Moreover, since the winding directions of the two coil elements are opposite, two kinds of winding heads are required.

An object of the present invention is to provide a coil component that can be processed easily when a plurality of coil elements that are arranged side-by-side are formed from a single flat wire, a reactor, and a method for forming a coil component.

According to a first aspect of the invention, a coil component is provided. The coil component comprises a plurality of coil elements arranged side-by-side and a connecting portion that interconnects the coil elements. The plurality of coil elements are formed from a single flat wire wound edgewise so that the coil elements wind in the same direction. The connecting portion includes a portion of the flat wire between the two coil elements wound edgewise, wherein a part of the connection portion protrudes radially outward from the two coil elements. The connecting portion is bent flatwise at two positions so that the two coil elements are arranged side-by-side with their axes in parallel with each other.

According to a second aspect of the invention, a method for forming a coil component is provided. The method comprises winding a flat wire edgewise around a single axis so that a plurality of coil elements are formed and wound in the same direction and a connecting portion interconnecting the two coil elements so that a part of the connecting portion protrudes radially outward from the two coil elements; and after winding the flat wire edgewise, bending the connecting portion flatwise at two positions so that the two coil elements are arranged side-by-side with their axes in parallel with each other.

DETAILED DESCRIPTION OF THE PREFERRED EMBODIMENTS

A first embodiment of the present invention will be described below with reference to the drawings.

Figure 1:
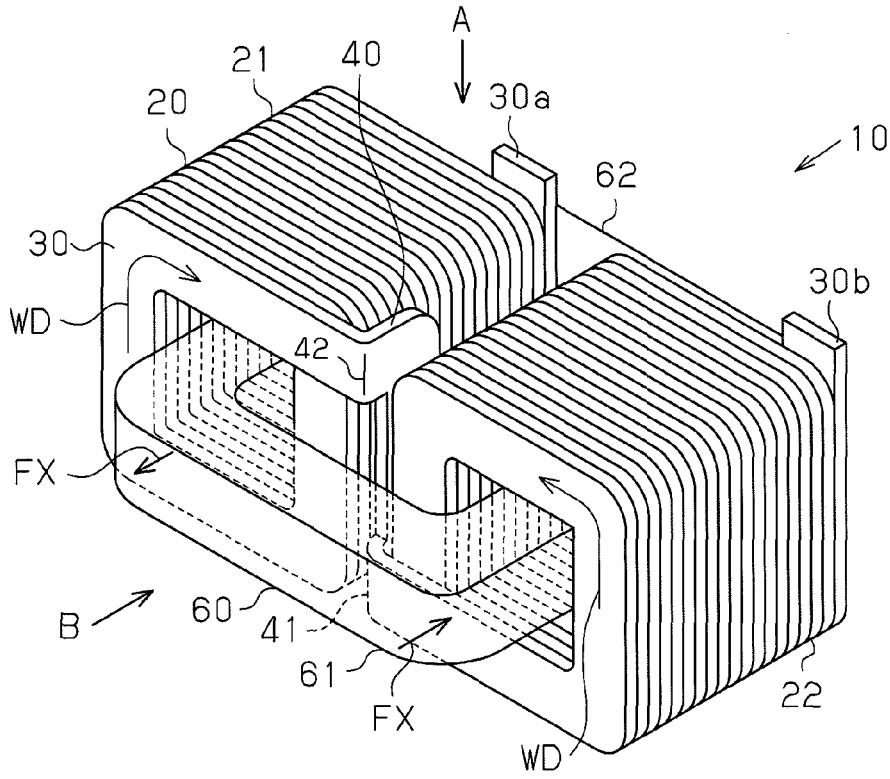
FIG. 1 is a perspective view of a reactor in accordance with a first embodiment.
Figure 2:
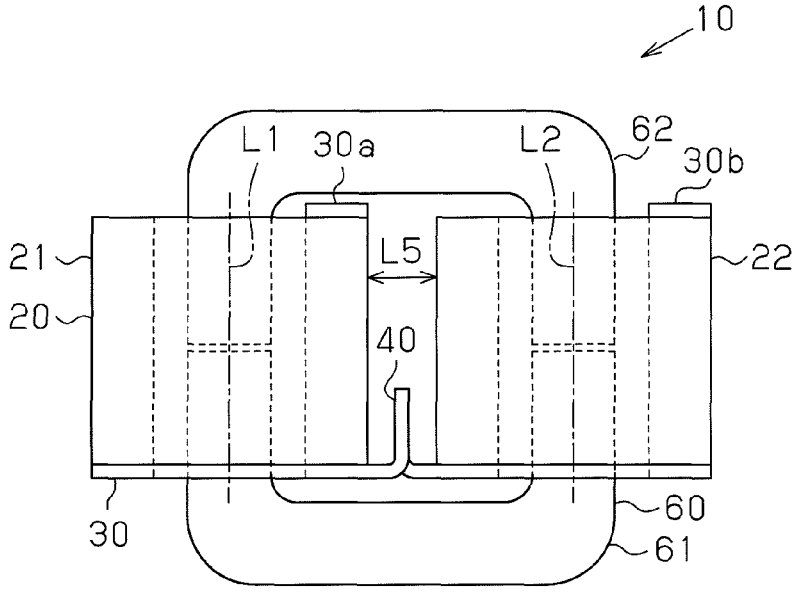
FIG. 2 is a plan view of the reactor of FIG. 1.
Figure 3:
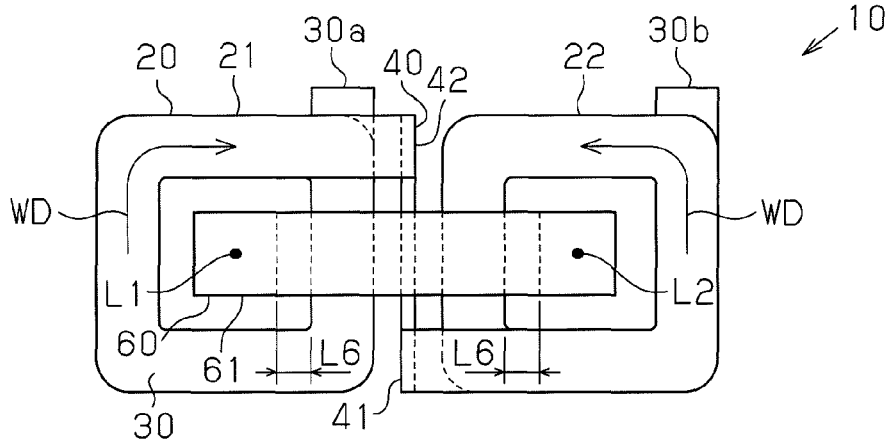
FIG. 3 is a front view of the reactor of FIG. 1.

FIG. 1 illustrates a perspective view of a reactor 10 in accordance with the first embodiment. FIGS. 2 and 3 illustrate a plan view (viewed in the direction of the arrow A in FIG. 1) and a front view (viewed in the direction of the arrow B in FIG. 1) of the reactor 10 in FIG. 1, respectively.

Throughout the drawings, the arrow FX denotes density of magnetic flux of a coil element 21 or 22 and the arrow WD denotes the winding direction of a flat wire 30.

The reactor 10 includes a coil component 20 and a UU-type core 60. The UU-type core 60 is comprised of a U-type core 61 and a U-type core 62. The U-type core 61 has a rectangular cross-sectional area, and is U-shaped when viewed in plan view as in FIG. 2. Similarly, the U-type core 62 also has a rectangular cross-sectional area, and is U-shaped when viewed in plan view as in FIG. 2. Both end faces of the U-type core 61 oppose both end faces of the U-type core 62 in proximity thereto.

Of the coil component 20, a rectangular annular coil element 21 is wound around one of the opposing faces of the U-type core 61 and the U-type core 62, and a rectangular annular coil element 22 is wound around the other of the opposing faces of the U-type core 61 and the U-type core 62.

Figure 4:
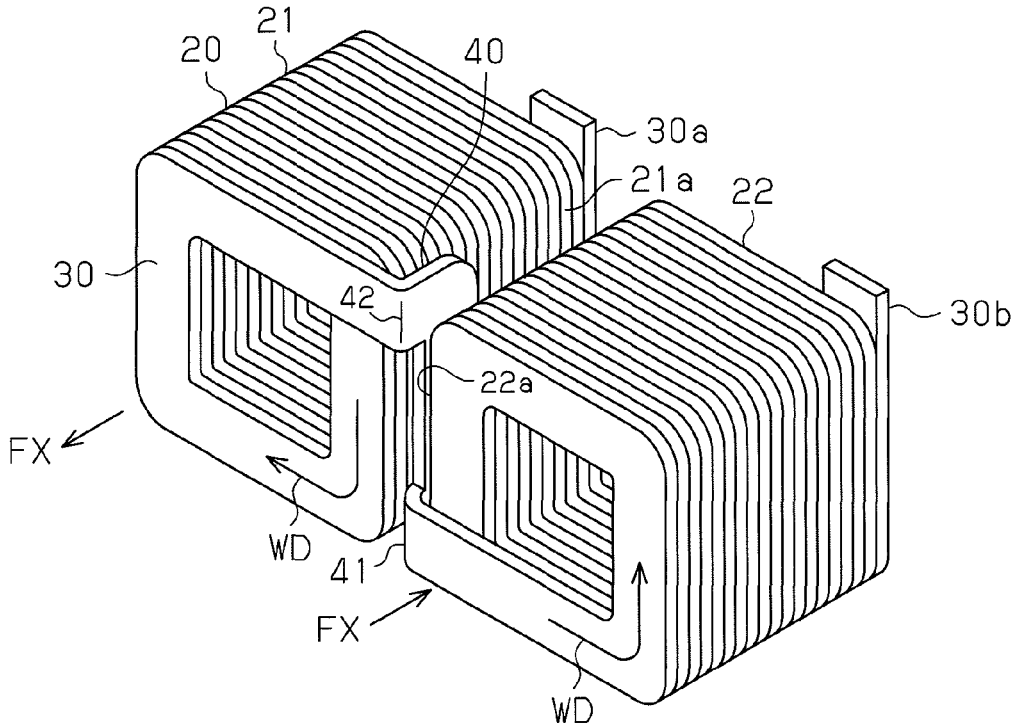
FIG. 4 is a perspective view of the coil component.

As illustrated in FIG. 4, the coil component 20 includes the first coil element 21 and second coil element 22. The first coil element 21 has a rectangular annular configuration and the second coil element 22 has a rectangular annular configuration. The axial line of the coil element 21 is denoted as L1 and the axial line of coil element 22 is denoted as L2 (See FIG. 2).

Figure 5:
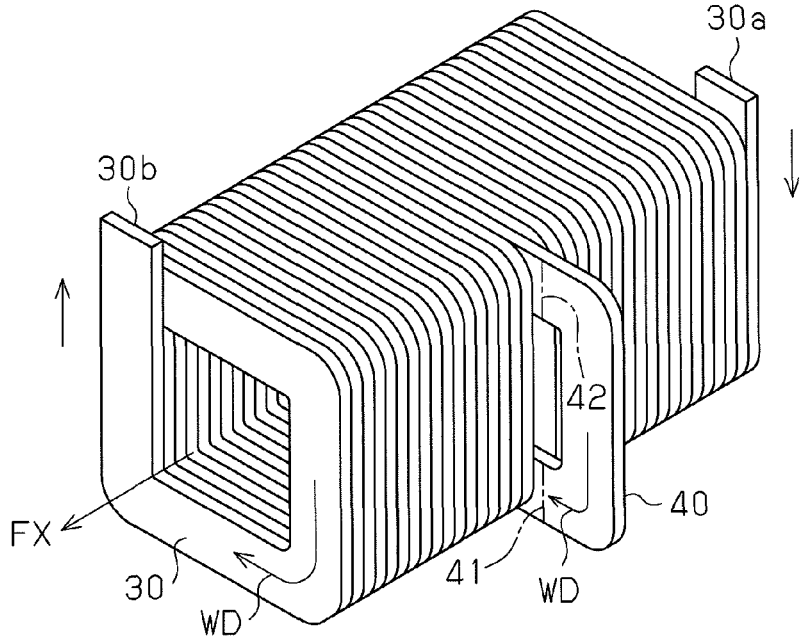
FIGS. 5 and 6 are perspective views illustrating steps of forming the coil component of FIG. 4.

The first coil element 21 and the second coil element 22 are arranged side-by-side with each other. The first coil element 21 and the second coil element 22 are formed by winding a flat wire 30 having a rectangular cross-sectional area in an edgewise way. The winding directions for the first and second elements 21 and 22 are the same. Specifically, as illustrated in FIG. 5, the flat wire 30 is wound edgewise around a single axis before the two coil elements 21 and 22 are formed. The flat wire 30 is made of copper. As used herein, the term "edgewise winding" refers to winding around the shorter side of the longitudinal cross-sectional area of the flat wire.

As illustrated in FIG. 4, the coil component 20 includes a connecting portion 40 of the flat wire 30. The connecting portion 40 interconnects the two coil elements 21 and 22. The connecting portion 40 of the coil component 20 is formed by extending the flat wire 30 radially outward by edgewise winding so that a part of the connecting portion 40 protrudes from the coil elements 21 and 22. Specifically, the connecting portion 40 protrudes traverse to the opposing side faces 21*a* and 22*a* of the coil elements 21 and 22.

As illustrated in FIG. 5, the connecting portion 40 of the coil component 20 includes a first bending line 41 and a second bending line 42. As illustrated in FIG. 4, at the first bending line 41, the connecting portion 40 is bent flatwise perpendicularly, i.e., at an angle of 90 degrees. Similarly, at the second bending line 42 of FIG. 5, the connecting portion 40 is bent over flatwise perpendicularly, i.e., at an angle of 90 degrees, as illustrated in FIG. 4.

As used herein, the term "flatwise bending" refers to bending around the longer side of the longitudinal cross-sectional area of the flat wire.

Thus, by bending the connecting portion 40 at the two portions (at the bending lines 41 and 42) flatwise, the coil elements 21 and 22 are placed in parallel with each other so that their axes L1 and L2 are parallel (see FIG. 2).

In the first coil element 21 of the coil component 20, one end 30*a* of the flat wire 30 protrudes upward (radially outward) for use as a connecting terminal. Similarly, in the second coil element 22, the other end of the flat wire 30 protrudes upward (radially outward) for use as a connecting terminal.

Next, a method for making the reactor 10 will be described.

First, a method of forming the coil component 20 will be described.

As illustrated in FIG. 5, a single flat wire 30 having the rectangular cross-sectional area is wound in an edgewise way to form a plurality of coil elements 21 and 22 that have the same winding directions and that have rectangular annular configurations around a shared single axis. At the same time, the connecting portion 40 of the flat wire 30 that interconnects the consecutive coil elements 21 and 22 is formed by winding the flat wire 30 in an edgewise way so that a part of the connecting portion 40 protrudes radially outward from the two coil elements 21 and 22. This is a process of edgewise winding.

Figure 6:
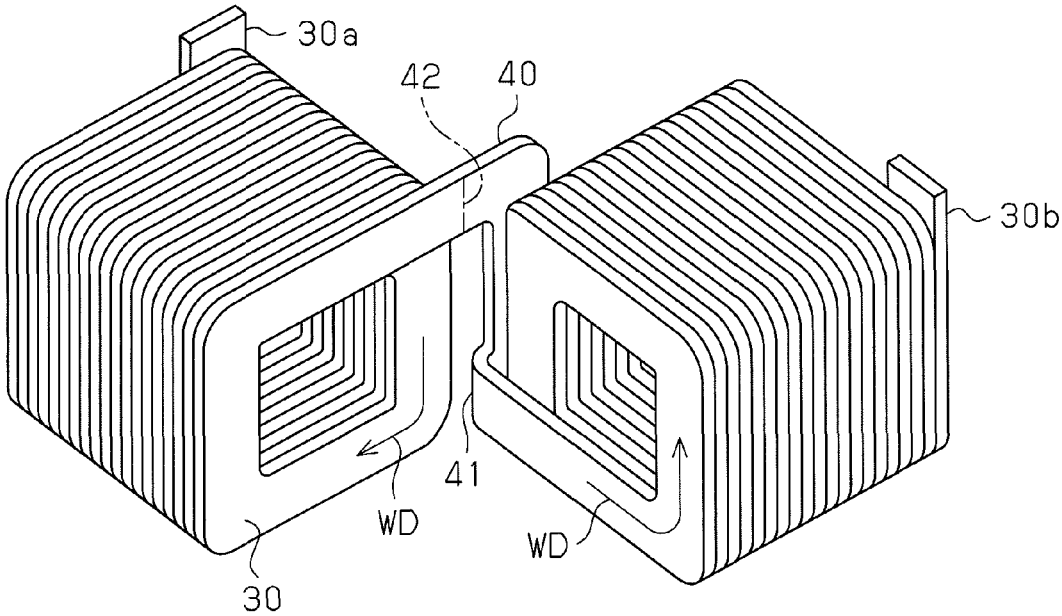

After the process of edgewise winding, as illustrated in FIG. 6, the connecting portion 40 of the flat wire 30 is bent at the first bending line 41 at an angle of 90 degrees. Next, as illustrated in FIG. 4, the connecting portion 40 is bent at the second bending line 42 at an angle of 90 degrees. Thus, the connecting portion 40 is bent at the two portions so that the coil elements 21 and 22 are placed in parallel with each other so that their axes L1 and L2 are parallel. This is a process of flatwise bending.

Thus, a process of flatwise bending is conducted at the two portions in two steps. Subsequently, as illustrated in FIGS. 1, 2 and 3, distal ends of the U-type cores 61 and 62 are inserted into the coil elements 21 and 22 to make both end faces of the U-type cores 61 and 62 oppose each other in proximity thereto.

As described above, two coil elements 21 and 22 at a time are wound around, with only the size of an intermediate turn of the flat wire 30 changed to make a connecting portion 40, and then the connecting portion 40 is bent two times in a flatwise manner, i.e., the connecting portion is bent twice. That is, an entire single wire 30 is bent edgewise around a single axis, and then the wire 30 is bent flatwise two times to completely form a coil component 20 (coil elements 21 and 22). The direction of current flow flowing in the connecting portion 40 is the same as the direction of current flow flowing in the coil elements 21 and 22. A magnetomotive force occurs at the connecting portion 40, so the connecting portion 40 can be used as a quarter turn.

Accordingly, edgewise winding can be carried out at one time. In addition, the direction of edgewise winding does not need to be changed. Thus, the step is simplified and winding speed can be increased.

In more detail, if the two coil elements are formed by winding a single flat wire edgewise in a manner that two axes of the coil elements are offset as described in Japanese Patent No. 3737461, swing of winding at the time of coiling the flat wire becomes great. This makes increasing speed for making the coil difficult. On the other hand, the present embodiment enables increasing speed for making the coil because the coil elements are formed over a single axis.

In addition, in Japanese Laid-open Patent Publication No. 2007-305803, after winding of a first coil element is completed, all the straight flat wire is pulled out, and the flat wire is wound back to form a second coil element in the opposite direction. This is time-consuming due to the necessity for the time required for pulling out the flat wire. In addition, increasing speed is difficult since swing of the first coil element prevents smooth coiling of the second coil element. On the other hand, the present embodiment enables shortening the time due to obviating the need for pulling out the flat wire as well as increasing speed due to formation of the two coil elements over a single axis. Further, since the winding directions of the coil elements are the same, the present embodiment needs only one kind of winding head whereas JP No. 2007-305803A needs two kinds of winding heads.

The present embodiment has the following advantages.

(1) As structure for the coil component 20, a plurality of the coil elements 21 and 22 arranged side-by-side are formed by winding a single flat wire 30 in an edgewise way. The connecting portion 40 of the flat wire 30 that bridges the coil element 21 and a part of the coil element 22 is projected radially outward from the two coil elements 21 and 22. Then the connecting portion 40 is bent flatwise at two positions (the bending lines 41 and 42) so that the coil elements 21 and 22 are arranged in parallel with their axes L1 and L2 in parallel with each other.

The edgewise winding can be performed at one time. In addition, the connecting portion 40 between the coil elements 21 and 22 can be formed by flatwise bending at the two positions. This facilitates the process. Consequently, a plurality of coil elements 21 and 22 are arranged in parallel and are formed by easily processing a single flat wire 30.

(2) The two coil elements 21 and 22 have rectangular annular configurations. Thus, a part of the connecting portion 40 of the flat wire 30 is easily made to protrude radially outward from the coil elements 21 and 22 by winding edgewise.

(3) As structure for the reactor 10, a core (a UU-type core 60) is placed in the coil component 20. This facilitates processing of the core as well as miniaturization of a reactor.

(4) The method of forming the coil component 20 comprises a process of edgewise winding and a process of flatwise bending. In the process of edgewise winding, a single flat wire 30 is wound edgewise along one axis to form a plurality of coil elements 21 and 22 that are wound in the same directions. In addition, the connecting portion 40 that bridges or interconnects the two coil elements 21 and 22 is formed by winding the flat wire 30 edgewise so that a part of the connecting portion 40 projects radially outward from the two coil elements 21 and 22. In the process of flatwise bending after the edgewise winding, the connecting portion 40 is bent flatwise at the two positions, so that the coil elements 21 and 22 are arranged side-by-side with their axes L1 and L2 in parallel with each other. This results in the coil component of the item (1).

(5) A process of flatwise bending at the two positions comprises two separate steps. Thus, precise flatwise bending is ensured.

Next, a second embodiment will be described while focusing on different points from the first embodiment.

Figure 7A:
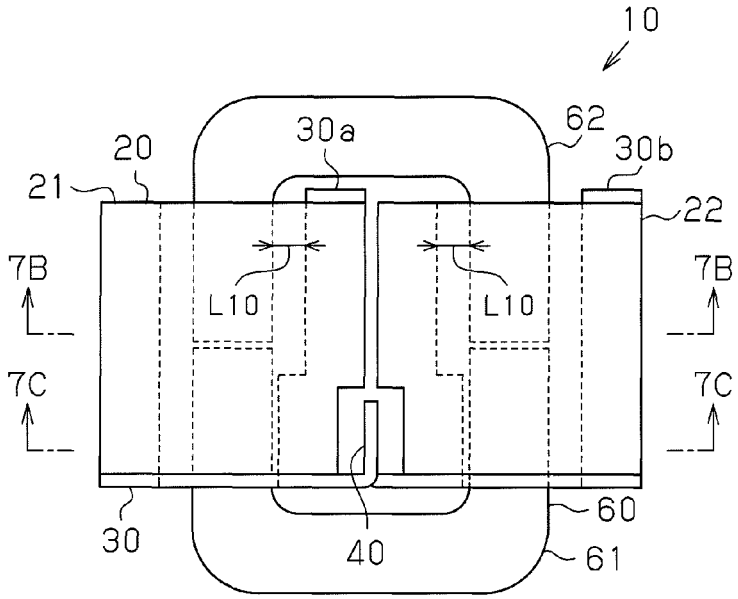
FIG. 7A is a plan view of the reactor in accordance with a second embodiment.
Figure 7B:
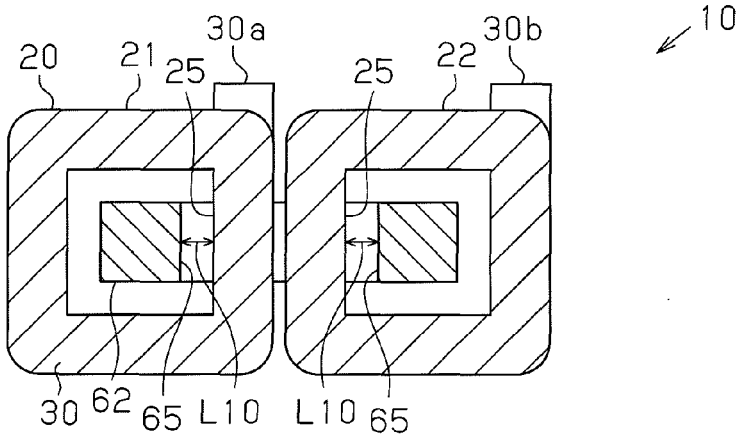
FIG. 7B is a sectional view along with the line 7B-7B in FIG. 7A.

FIG. 7A illustrates a reactor of the second embodiment that is an alternative for the reactor of FIG. 2. FIG. 7B is a cross-sectional view along the line 7B-7B in FIG. 7A. FIG. 7B is a cross-sectional view along the line 7C-7C in FIG. 7A. In FIG. 7A, there is an air gap between the end faces of the U-type core 61 and end faces of the U-type core 62.

Figure 8:
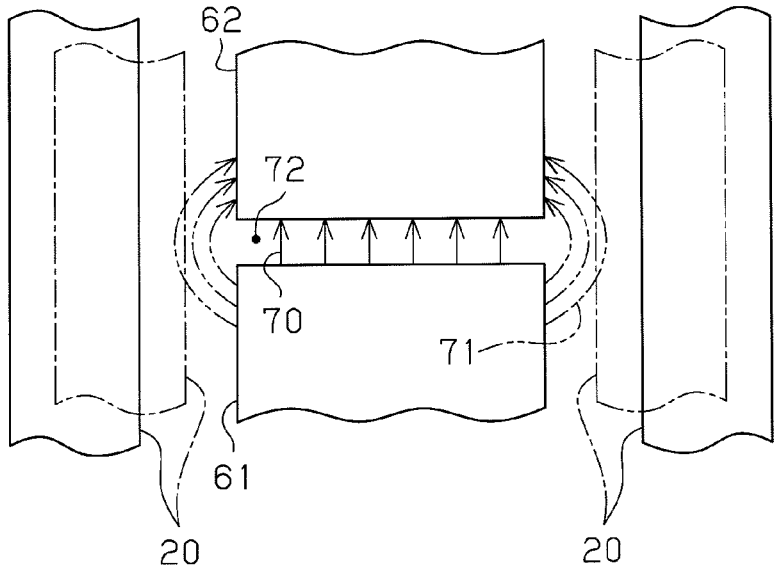
FIG. 8 is an enlarged view of an air gap between cores in the reactor to illustrate status of magnetic fluxes near the gap formed between the cores.

In this embodiment, the distance or spacing L5 (see FIG. 2) between the first coil element 21 and the second coil element 22 is made shorter to miniaturize the reactor. In FIGS. 2 and 3, space to displace the connecting portion 40 of the flat wire 30 is required between the first coil element 21 and the second coil element 22. On the other hand, if legs of the UU-type core 60 are placed closer (or when the UU-type core 60 is made smaller in the left and right directions in FIG. 2), the distance or spacing L6 (see FIG. 3) between the UU-type core 60 and the coil elements 21 and 22 becomes shorter. This causes leakage of magnetic flux 70 from an air gap 72 between the magnetic legs of the U-type cores 61 and 62 out of the U-type cores 61 and 62. When the leaked flux 71 link with the flat wire 30 of the coil component 20 (as indicated by the two-dot dashed line in FIG. 8), an eddy current generates in the coil in the coil component 20. Then, loss from eddy current becomes great.

Figure 7C:
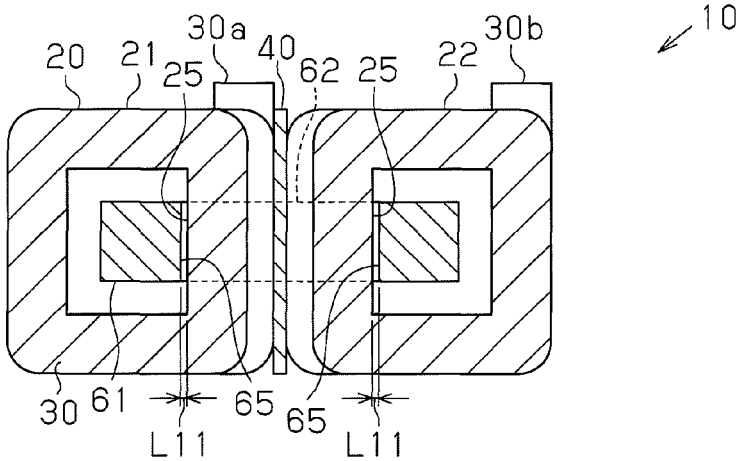
FIG. 7C is a sectional view along with the line 7C-7C in FIG. 7A.

In this embodiment, as illustrated in FIGS. 7A to 7C the first coil element 21 and the second coil element 22 are closer compared to the first embodiment while portions of the coil elements 21 and 22 at which the connecting portion 40 is located have reduced diameters to ensure space for accommodating the connecting portion 40 between the first coil element 21 and the second coil element 22.

As illustrated in FIG. 7B, along the location where an air gap between the coil elements 21 and 22 is formed, the distance or spacing L10 between each of an internal face 25 of the coil elements 21 and 22 and a corresponding outer face 65 of the UU-type core 60 (U-type core 61 and U-type core 62) have a fixed value. As illustrated in FIG. 7C, along the location where the connecting portion 40 of the flat wire 30 is placed, each of the internal face 25 of the coil elements 21 and 22 and the corresponding outer face 65 of the UU-type core 60 (U-type core 61 and U-type core 62) has a distance or a spacing L11. Compared to the distance or spacing L10, the distance or spacing L11 is narrower. That is, the diameters of the coil elements at the position where the connecting portion 40 is located is smaller than the diameters of the coil elements at the remaining position.

Figure 9:
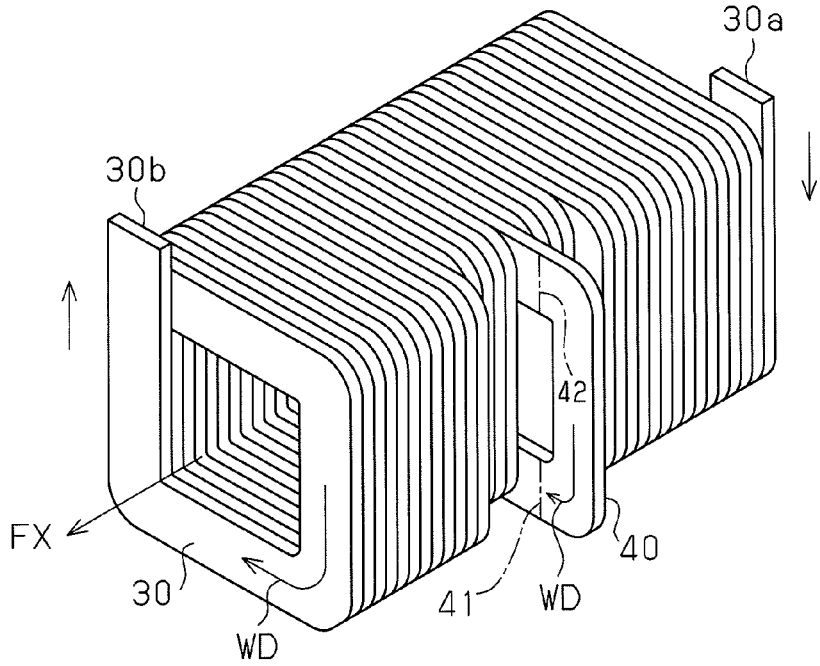
FIG. 9 is a perspective view illustrating steps for forming the coil component.

In forming a coil component, as illustrated in FIG. 9, which is an alternative for the arrangement of FIG. 5, the diameter of the coil is reduced at a specified area of a section corresponding to the first coil element 21 and at a specified area of a section corresponding to the second coil element 22. Then, the flat wire is bent as illustrated in FIG. 6 and FIG. 4 to form a coil component.

As described above, in this embodiment, the distance L11 between each of the internal face 25 of the coil elements 21 and 22 and the corresponding outer face 65 of the UU-type core 60 along the location where the connecting portion 40 of the flat wire 30 is placed is narrower than the distance L10 between each of an internal face 25 of the coil elements 21 and 22 and a corresponding outer face 65 of the UU-type core 60 along the location where a gap between the coil elements 21 and 22 are formed. Thus, the coil element 21 and the coil element 22 can be positioned in close proximity with each other while maintaining space for placing the connecting portion 40 between the two coil elements 21 and 22 and reducing loss from eddy current. As a result, the size of the reactor can be reduced.

Embodiments that fall within the scope of the inventions are not limited to the above embodiments but may include the following embodiments among others.

In the above embodiments, a process of flatwise bending is conducted at the two portions (the bending lines 41 and 42) in two steps. Instead of this, flatwise bending at the two portions can be conducted simultaneously.

The coil elements 21 and 22 may not have rectangular annular configurations.

In the second embodiment, the diameters of both of the coil elements 21 and 22 are reduced at the location where the connecting portion 40 is placed. Instead, the diameter of either of the coil elements 21 and 22 may be reduced.

The invention claimed is:

1. A coil component comprising a plurality of coil elements arranged side-by-side, wherein the plurality of coil elements are formed from a single flat wire wound edgewise so that the coil elements wind in the same direction; and a connecting portion that interconnects the coil elements, wherein the connecting portion includes a portion of the flat wire between the two coil elements wound edgewise, wherein a part of the connection portion protrudes radially outward from the two coil elements, and the connecting portion is bent flatwise at two positions so that the two coil elements are arranged side-by-side with their axes in parallel with each other.

2. The coil component according to claim 1, wherein the two coil elements have rectangular annular configurations.

3. The coil component according to claim 1, wherein the diameter of the coil element is reduced at the position where the connecting portion is located compared to the diameter of the coil element at the remaining position.

4. A reactor comprising a coil component according to claim 1 and a core placed in the coil component.

5. The reactor according to claim 4, wherein the core includes a gap, each of the two coil elements has an internal face, the core includes an outer face, and the distance between each of the internal face of the two coil elements and the outer face of the core along the location where the connecting portion of the flat wire is placed is narrower than the distance between each of the internal face of the two coil elements and the outer face of the core along the location where the gap between the two coil elements is formed.

6. A method for forming a coil component comprising:

winding a flat wire edgewise around a single axis so that a plurality of coil elements are formed and wound in the same direction and a connecting portion interconnecting the two coil elements so that a part of the connecting portion protrudes radially outward from the two coil elements; and after winding the flat wire edgewise, bending the connecting portion flatwise at two positions so that the two coil elements are arranged side-by-side with their axes in parallel with each other.

7. The method according to the claim 6 wherein bending the connecting portion flatwise at two positions is conducted in two steps.

8. The method according to the claim 6 wherein bending the connecting portion flatwise at two positions is conducted simultaneously.

* * * * *